US011703777B2

(12) United States Patent
Boettcher et al.

(10) Patent No.: US 11,703,777 B2
(45) Date of Patent: Jul. 18, 2023

(54) DRIVE AND SEAL ASSEMBLY FOR AN ELECTROPHOTOGRAPHIC IMAGE FORMING DEVICE

(71) Applicant: LEXMARK INTERNATIONAL, INC., Lexington, KY (US)

(72) Inventors: Brian Lester Boettcher, Versailles, KY (US); Brian Lee Hawes, Lexington, KY (US); David Lee Merrifield, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 17/717,543

(22) Filed: Apr. 11, 2022

(65) Prior Publication Data

US 2022/0236665 A1 Jul. 28, 2022

Related U.S. Application Data

(63) Continuation of application No. 16/905,092, filed on Jun. 18, 2020, now Pat. No. 11,327,417.

(60) Provisional application No. 62/874,226, filed on Jul. 15, 2019.

(51) Int. Cl.
*G03G 15/08* (2006.01)

(52) U.S. Cl.
CPC ..... *G03G 15/0889* (2013.01); *G03G 15/0875* (2013.01); *G03G 15/0881* (2013.01)

(58) Field of Classification Search
CPC ..... G03G 15/0889; G03G 15/0875; G03G 15/0881
See application file for complete search history.

(56) References Cited

U.S. PATENT DOCUMENTS

| | | | | |
|---|---|---|---|---|
| 6,246,854 | B1 * | 6/2001 | Kurosawa | G03G 15/0894 399/263 |
| 2013/0129377 | A1 * | 5/2013 | Satomura | G03G 21/18 399/106 |
| 2015/0117906 | A1 * | 4/2015 | Mori | G03G 15/0808 399/254 |
| 2016/0223949 | A1 * | 8/2016 | Taguchi | G03G 21/18 399/106 |

* cited by examiner

*Primary Examiner* — G. M. A Hyder
(74) *Attorney, Agent, or Firm* — Justin M. Tromp

(57) ABSTRACT

An assembly for use in an electrophotographic image forming device includes a housing having a reservoir for holding toner. The housing includes a wall having an inner surface forming a boundary of the reservoir and an outer surface opposite the inner surface. A toner agitator is positioned in the reservoir and has a rotatable shaft. The shaft includes an end portion that passes through an opening in the wall. A gear is mounted on the end portion of the shaft outside of the reservoir and is rotatably coupled to the shaft. An annular seal encircles and is in contact with an outer circumferential surface of the shaft. The annular seal is positioned between an inner axial face of the gear and the outer surface of the wall. The inner axial face of the gear contacts the annular seal and presses the annular seal against the outer surface of the wall.

4 Claims, 7 Drawing Sheets

DRIVE AND SEAL ASSEMBLY FOR AN ELECTROPHOTOGRAPHIC IMAGE FORMING DEVICE

CROSS REFERENCES TO RELATED APPLICATIONS

This application is a continuation application of U.S. patent application Ser. No. 16/905,092, filed Jun. 18, 2020, entitled "Drive and Seal Assembly for an Electrophotographic Image Forming Device," which claims priority to U.S. Provisional Patent Application Ser. No. 62/874,226, filed Jul. 15, 2019, entitled "Drive and Sealing Assembly for an Electrophotographic Image Forming Device," the contents of which are hereby incorporated by reference in their entireties.

BACKGROUND

1. Field of the Disclosure

The present disclosure relates generally to image forming devices and more particularly to a drive and sealing assembly for an electrophotographic image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles from a developer roll are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device's toner supply is typically stored in one or more replaceable units, such as a toner cartridge. The toner cartridge has a housing that forms a reservoir for storing toner and often includes one or more toner agitators to mix toner in the reservoir to prevent the toner from clumping. At least one end of a shaft of the toner agitator passes through a corresponding opening in the housing permitting the toner agitator to receive rotational motion from a drive train of the replaceable unit or the like. The opening through the housing creates a possible path for toner leakage that must be sealed in order to prevent toner from leaking from the toner cartridge. An assembly for providing rotational motion to the toner agitator and sealing the opening through the housing that the shaft of the toner agitator passes through in an effective, cost-efficient and compact manner is desired.

SUMMARY

An assembly for use in an electrophotographic image forming device according to one example embodiment includes a housing having a reservoir for holding toner. The housing includes a wall having an inner surface forming a boundary of the reservoir and an outer surface opposite the inner surface. A toner agitator is positioned in the reservoir and has a rotatable shaft. The shaft includes an end portion that passes through an opening in the wall. A gear is mounted on the end portion of the shaft outside of the reservoir and is rotatably coupled to the shaft. An annular seal encircles and is in contact with an outer circumferential surface of the shaft. The annular seal is positioned between an inner axial face of the gear and the outer surface of the wall. The inner axial face of the gear contacts the annular seal and presses the annular seal against the outer surface of the wall.

An assembly for use in an electrophotographic image forming device according to another example embodiment includes a housing having a reservoir for holding toner. The housing includes a wall having an inner surface forming a boundary of the reservoir and an outer surface opposite the inner surface. A toner agitator is positioned in the reservoir and has a rotatable shaft. The shaft includes an end portion that passes through an opening in the wall. A boss is integrally formed with and projects from the outer surface of the wall about the opening. A gear is mounted on the end portion of the shaft outside of the reservoir and is rotatably coupled to the shaft. The gear has an inner circumferential surface that contacts and bears against the boss facilitating rotation of the gear about the boss.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
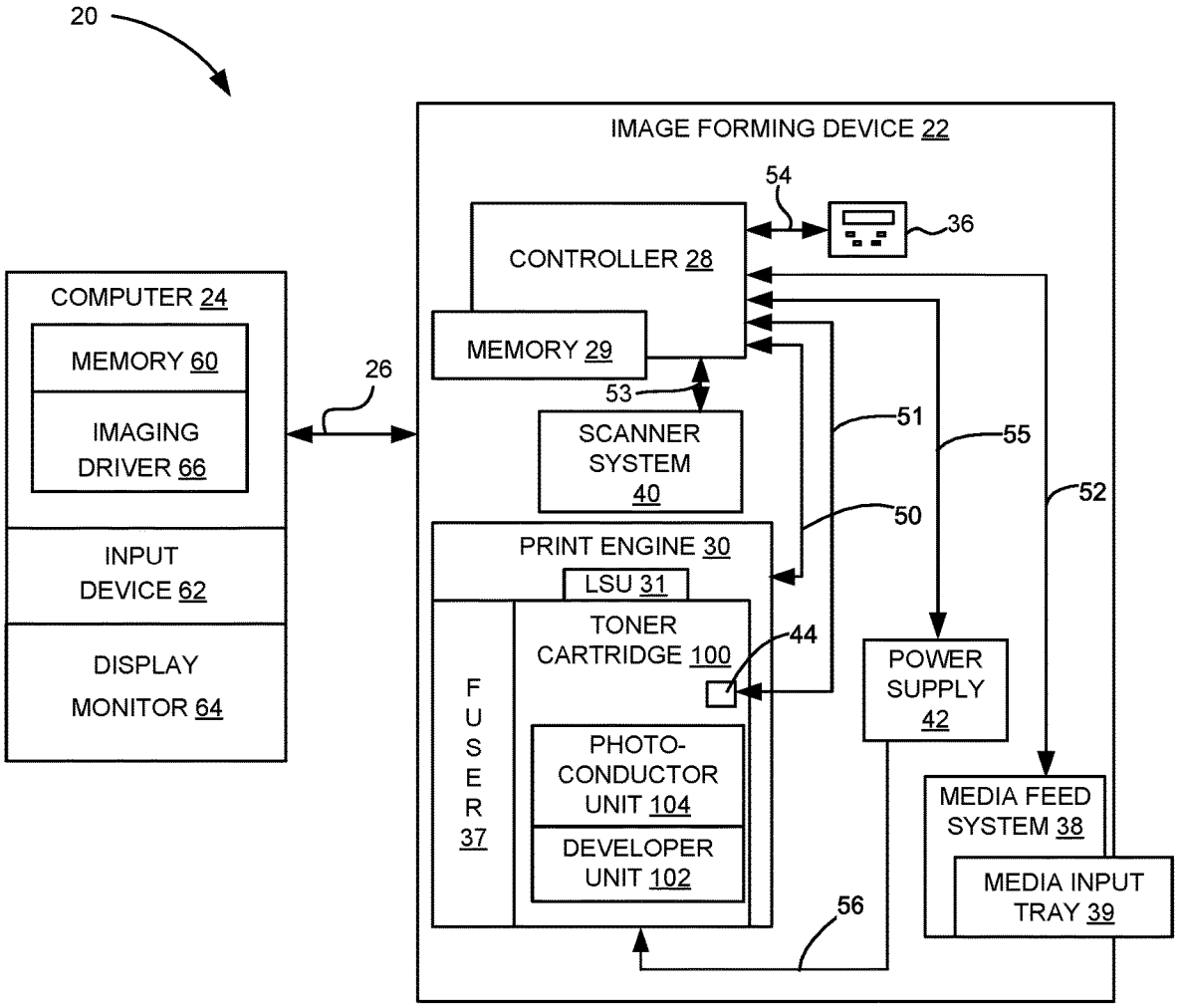
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, a toner cartridge 100, a user interface 36, a media feed system 38, a media input tray 39, a scanner system 40 and a power supply 42. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated memory 29. The processor unit may include one or more integrated circuits in the form of a microprocessor or central processing unit and may be formed as one or more Application-Specific Integrated Circuits (ASICs). Memory 29 may be any volatile or non-volatile memory or combination thereof such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with media feed system 38 via a communications link 52. Controller 28 communicates with scanner system 40 via a communications link 53. User interface 36 is communicatively coupled to controller 28 via a communications link 54. Controller 28 communicates with power supply 42 via a communications link 55. Controller 28 processes print and scan data and operates print engine 30 during printing and scanner system 40 during scanning. Processing circuitry 44 may provide authentication functions, safety and operational interlocks, operating parameters and usage information related to toner cartridge 100. Processing circuitry 44 includes a processor unit and associated electronic memory. As discussed above, the processor may include one or more integrated circuits in the form of a microprocessor or central processing unit and/or may include one or more Application-Specific Integrated Circuits (ASICs). The memory may be any volatile or non-volatile memory or combination thereof or any memory device convenient for use with processing circuitry 44.

Computer 24, which is optional, may be, for example, a personal computer, including memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes laser scan unit (LSU) 31, toner cartridge 100 and a fuser 37, all mounted within image forming device 22. Toner cartridge 100 is removably mounted in image forming device 22. Power supply 42 provides an electrical voltage to various components of toner cartridge 100 via an electrical path 56. Toner cartridge 100 includes a developer unit 102 that houses a toner reservoir and a toner development system. In one embodiment, the toner development system utilizes what is commonly referred to as a single component development system. In this embodiment, the toner development system includes a toner adder roll that provides toner from the toner reservoir to a developer roll. A doctor blade provides a metered uniform layer of toner on the surface of the developer roll. In another embodiment, the toner development system utilizes what is commonly referred to as a dual component development system. In this embodiment, toner in the toner reservoir of developer unit 102 is mixed with magnetic carrier beads. The magnetic carrier beads may be coated with a polymeric film to provide triboelectric properties to attract toner to the carrier beads as the toner and the magnetic carrier beads are mixed in the toner reservoir. In this embodiment, developer unit 102 includes a developer roll that attracts the magnetic carrier beads having toner thereon to the developer roll through the use of magnetic fields. Toner cartridge 100 also includes a photoconductor unit 104 that houses a charge roll, a photoconductive drum and a waste toner removal system. Although the example image forming device 22 illustrated in FIG. 1 includes one toner cartridge, in the case of an image forming device configured to print in color, separate toner cartridges may be used for each toner color. For example, in one embodiment, the image forming device includes four toner cartridges, each toner cartridge containing a particular toner color (e.g., black, cyan, yellow and magenta) to permit color printing.

Figure 2:
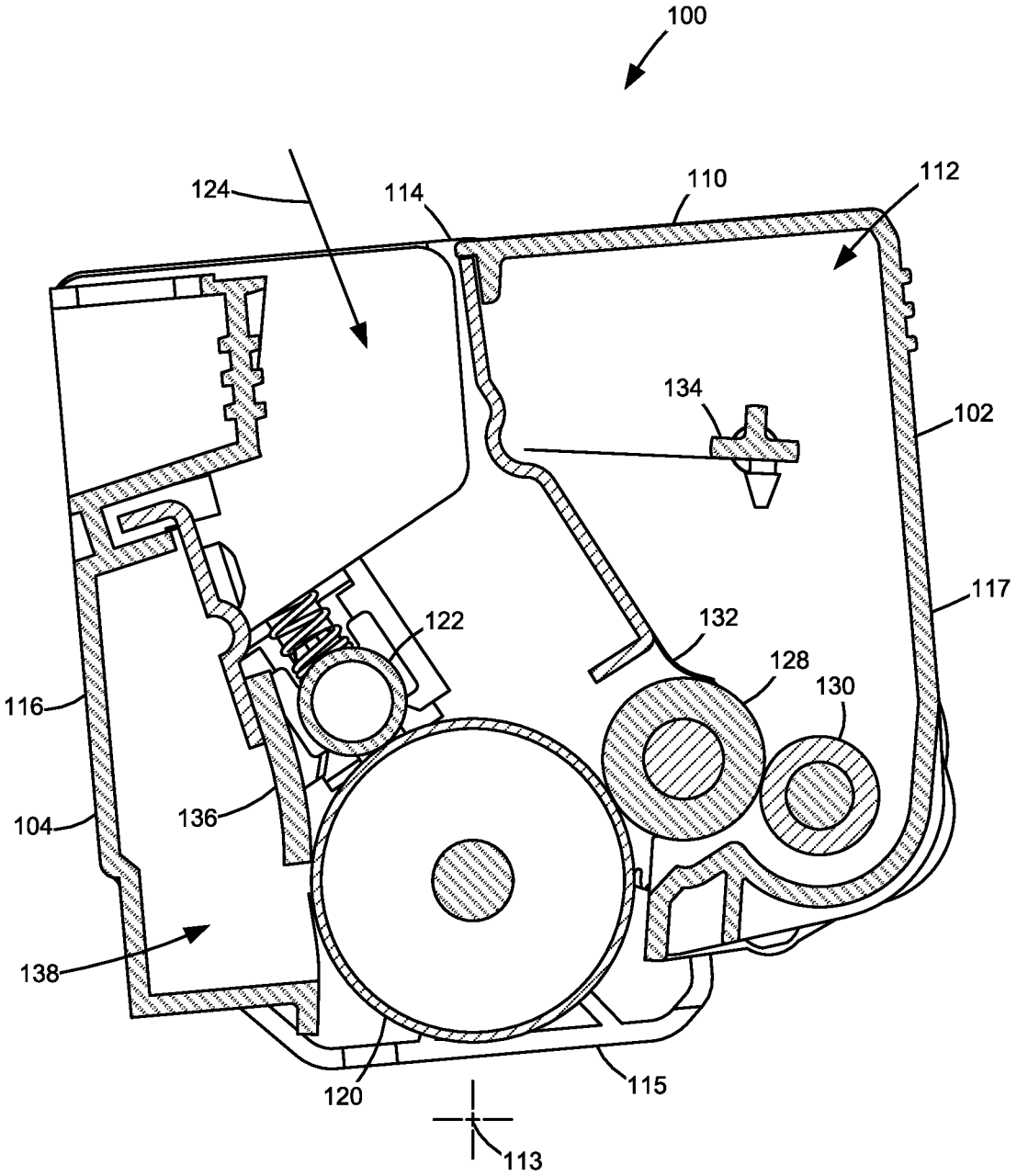
FIG. 2 is a cross-sectional view of a toner cartridge of the imaging system according to one example embodiment.

FIG. 2 shows toner cartridge 100 according to one example embodiment. Toner cartridge 100 includes an elongated housing 110 that includes walls forming a toner reservoir 112. In the example embodiment illustrated, housing 110 extends along a longitudinal dimension 113 and includes a top 114, a bottom 115, a side 116 and a side 117 that extend between longitudinal ends 118, 119 (FIG. 3) of housing 110. In this embodiment, developer unit 102 is positioned along side 117 of housing 110 and photoconductor unit 104 is positioned along side 116 of housing 110.

The electrophotographic printing process is well known in the art and, therefore, is described briefly herein. During a printing operation, a rotatable charge roll 122 of photoconductor unit 104 charges the surface of a rotatable photoconductive drum 120. The charged surface of photoconductive drum 120 is then selectively exposed to a laser light source 124 from LSU 31 through a slit (not shown) in the top 114 of housing 110 to form an electrostatic latent image on photoconductive drum 120 corresponding to the image to be printed. Charged toner from developer unit 102 is picked up by the latent image on photoconductive drum 120 creating a toned image on the surface of photoconductive drum 120. Charge roll 122 and photoconductive drum 120 are each electrically charged to a respective predetermined voltage by power supply 42 in order to achieve a desired voltage differential between the charged portions of the surface of photoconductive drum 120 and the portions of the surface of photoconductive drum 120 discharged by laser light source 124.

Developer unit 102 includes toner reservoir 112 having toner stored therein and a rotatable developer roll 128 that supplies toner from toner reservoir 112 to photoconductive drum 120. In the example embodiment illustrated, a rotatable toner adder roll 130 in developer unit 102 supplies toner from toner reservoir 112 to developer roll 128. A doctor blade 132 disposed along developer roll 128 provides a substantially uniform layer of toner on developer roll 128 for transfer to photoconductive drum 120. As developer roll 128 and photoconductive drum 120 rotate, toner particles are electrostatically transferred from developer roll 128 to the latent image on photoconductive drum 120 forming a toned image on the surface of photoconductive drum 120. In one embodiment, developer roll 128 and photoconductive drum 120 rotate in opposite rotational directions such that their adjacent surfaces move in the same direction to facilitate the transfer of toner from developer roll 128 to photoconductive drum 120. One or more movable toner agitators 134 may be provided in toner reservoir 112 to distribute the toner therein and to break up any clumped toner. Developer roll 128 and toner adder roll 130 are each electrically charged to a respective predetermined voltage by power supply 42 in order to attract toner from reservoir 112 to toner adder roll 130 and to electrostatically transfer toner from toner adder roll 130 to developer roll 128 and from developer roll 128 to the latent image on the surface of photoconductive drum 120. Doctor blade 132 may also be electrically charged to a predetermined voltage by power supply 42 as desired.

The toned image is then transferred from photoconductive drum 120 to the print media (e.g., paper) either directly by photoconductive drum 120 or indirectly by an intermediate transfer member. In the example embodiment illustrated, the surface of photoconductive drum 120 is exposed from housing 110 along the bottom 115 of housing 110 where the toned image transfers from photoconductive drum 120 to the print media or intermediate transfer member. Fuser 37 (FIG. 1) then fuses the toner to the print media. A cleaner blade 136 (or cleaner roll) of photoconductor unit 104 removes any residual toner adhering to photoconductive drum 120 after the toner is transferred from photoconductive drum 120 to the print media or intermediate transfer member. Waste toner from cleaner blade 136 may be held in a waste toner reservoir 138 in photoconductor unit 104 as illustrated or moved to a separate waste toner container. The cleaned surface of photoconductive drum 120 is then ready to be charged again and exposed to laser light source 124 to continue the printing cycle.

Figure 3:
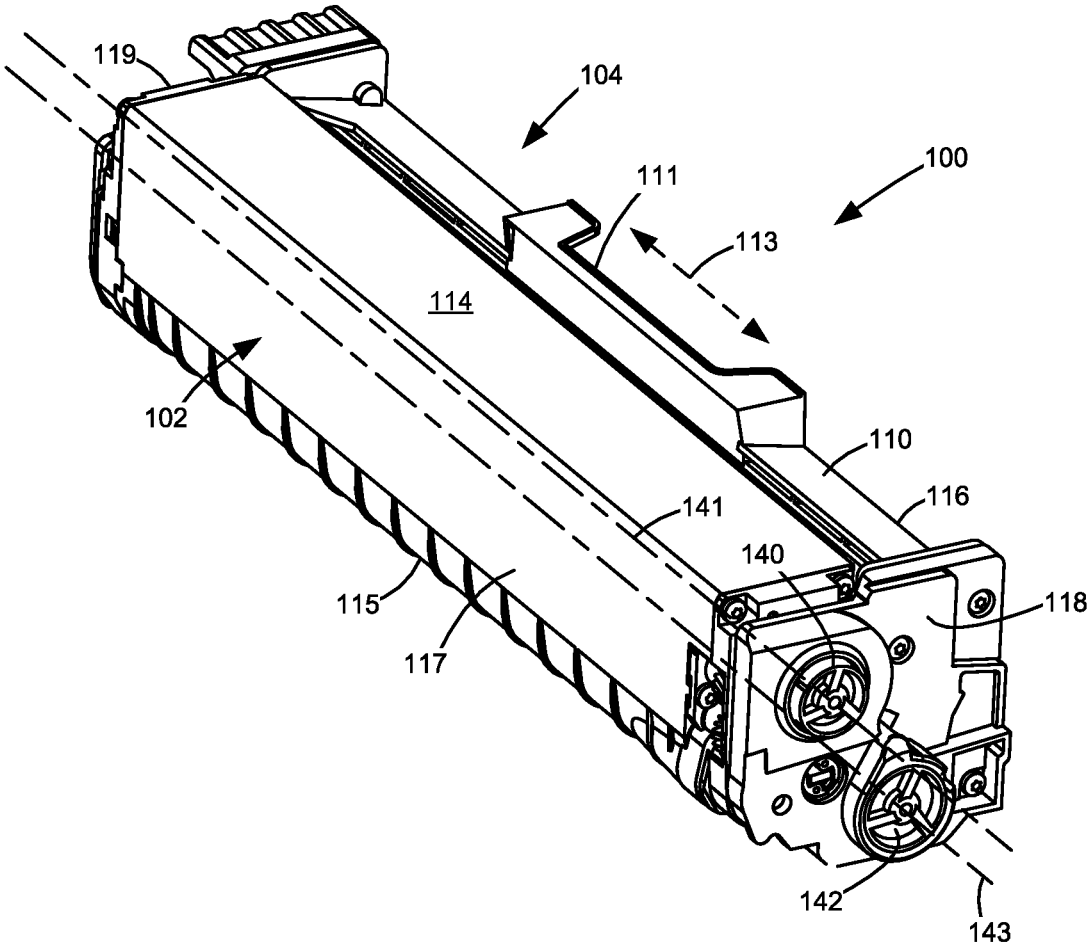
FIG. 3 is a perspective view of the toner cartridge according to one example embodiment.

FIG. 3 shows the exterior of toner cartridge 100 according to one example embodiment. As shown, in this embodiment, developer unit 102 is positioned at side 117 of housing 110 and photoconductor unit 104 is positioned at side 116 of housing 110. In the example embodiment illustrated, toner cartridge 100 includes a handle 111 positioned along side 116 and/or top 114 of housing 110 to assist the user with handling toner cartridge 100.

In the example embodiment illustrated, a pair of drive couplers 140, 142 are exposed on an outer portion of housing 110 in position to receive rotational force from a corresponding drive system in image forming device 22 when toner cartridge 100 is installed in image forming device 22 to drive rotatable components of developer unit 102 and photoconductive drum 120, respectively. The drive system in image forming device 22 includes one or more drive motors and a drive transmission from the drive motor (s) to a pair of drive couplers that mate with drive couplers 140, 142 of toner cartridge 100 when toner cartridge 100 is installed in image forming device 22. In the example embodiment illustrated, drive couplers 140, 142 are each exposed on end 118 of housing 110. Each drive coupler 140, 142 includes a rotational axis 141, 143. In the example embodiment illustrated, drive couplers 140, 142 are each configured to mate with and receive rotational motion from the corresponding drive couplers in image forming device 22 at the axial ends of drive couplers 140, 142. Drive coupler 140 is operatively connected (either directly or indirectly through one or more intermediate gears) to rotatable components of developer unit 102 including, for example, developer roll 128, toner adder roll 130 and toner agitator 134, to rotate developer roll 128, toner adder roll 130 and toner agitator 134 upon receiving rotational force from the corresponding drive system in image forming device 22. Drive coupler 142 is operatively connected (either directly or indirectly through one or more intermediate gears) to photoconductive drum 120 upon receiving rotational force from the corresponding drive system in image forming device 22. In some embodiments, charge roll 122 is driven by friction contact between the surfaces of charge roll 122 and photoconductive drum 120. In other embodiments, charge roll 122 is connected to drive coupler 142 by one or more gears. Any additional rotatable components of photoconductor unit 104, e.g., one or more toner agitators or augers positioned in waste toner reservoir 138, if present, may be connected to drive coupler 142 by one or more gears.

Figure 4:
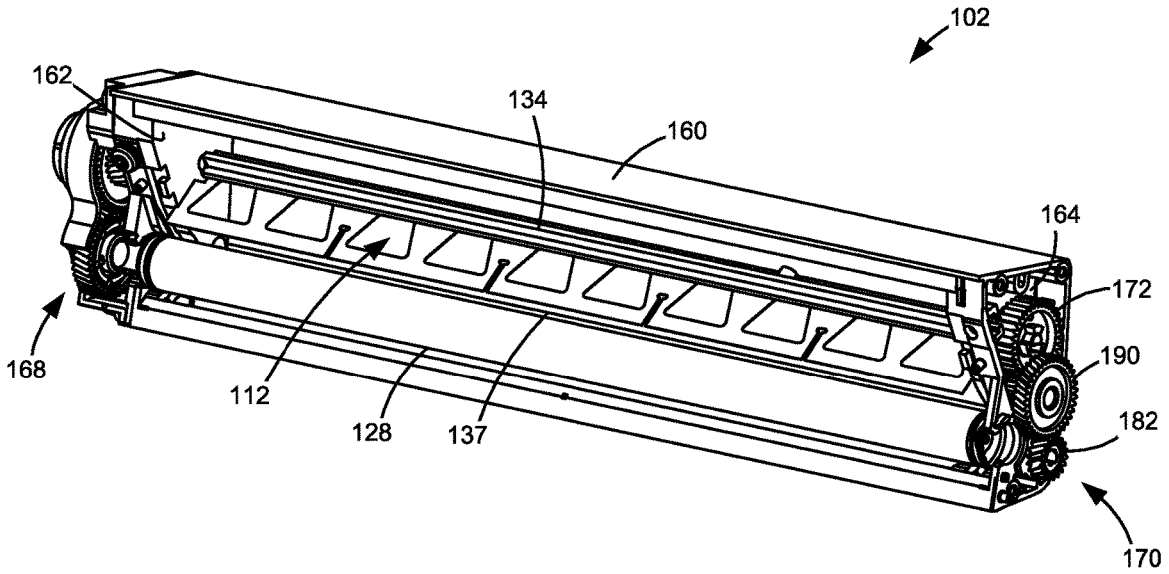
FIG. 4 is a perspective view of a developer unit of the toner cartridge of FIG. 3 showing internal components of the developer unit according to one example embodiment.
Figure 5:
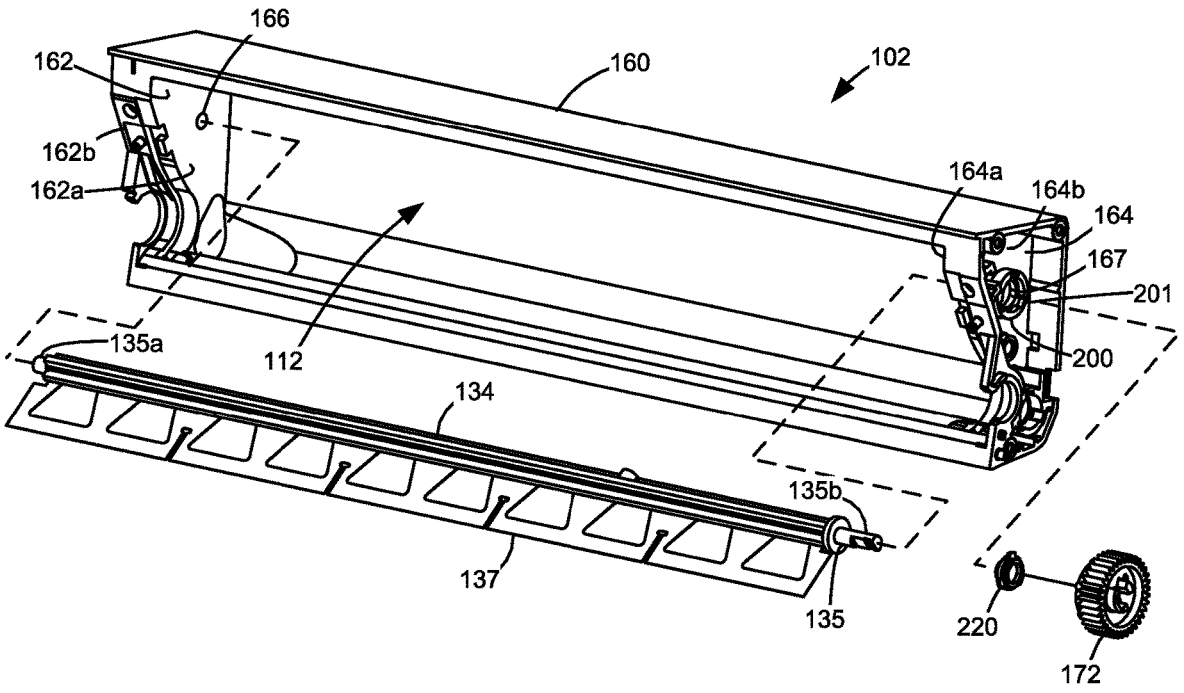
FIG. 5 is an exploded view of the developer unit of FIG. 4 according to one example embodiment.

FIG. 4 shows developer unit 102 separated from photoconductor unit 104 with portions of developer unit 102 omitted to better illustrate the positions of developer roll 128 and toner agitator 134 within toner reservoir 112. In FIG. 5, developer unit 102 is shown with toner agitator 134 in an exploded view. Developer unit 102 includes a body 160 having walls forming toner reservoir 112. In the example embodiment illustrated, body 160 includes opposed first and second end walls 162, 164 each having a respective inner surface 162*a*, 164*a* forming a wall boundary of toner reservoir 112. First and second drive mechanisms 168, 170 are positioned at respective outer surfaces 162*b*, 164*b* of first and second end walls 162, 164, opposite inner surfaces 162*a*, 164*a*. In the example embodiment illustrated, first drive mechanism 168 at outer surface 162*b* of first end wall 162 operatively connects drive coupler 140 to developer roll 128 and toner adder roll 130 such that first drive mechanism 168 rotates developer roll 128 and toner adder roll 130 when drive coupler 140 rotates. In this embodiment, second drive mechanism 170 at outer surface 164*b* of second end wall 164 operatively connects toner agitator 134 to first drive mechanism 168 via toner adder roll 130 such that second drive mechanism 170 rotates toner agitator 134 when first drive mechanism 168 rotates, as discussed in greater detail below.

Figure 6:
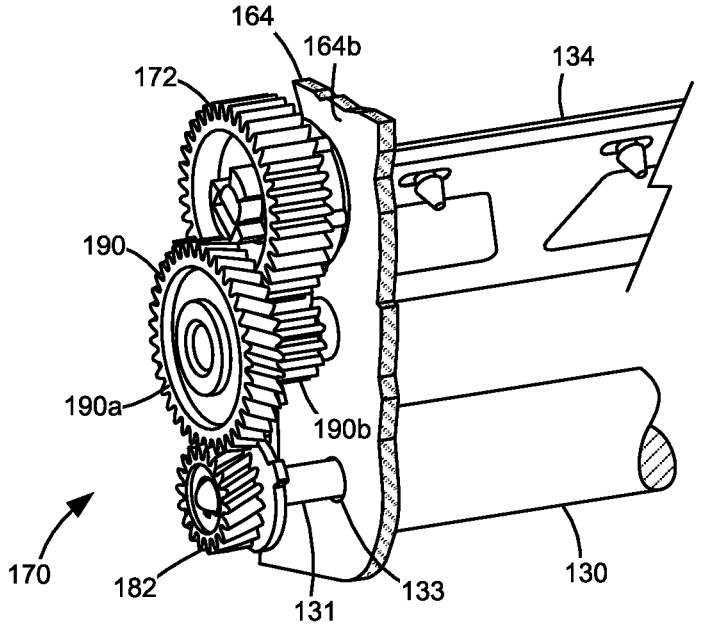
FIG. 6 is a perspective view of a drive mechanism of the developer unit of FIG. 4 according to one example embodiment.

In the example embodiment illustrated, toner agitator 134 has a shaft 135 that extends along the length of body 160. First and second axial ends 135*a*, 135*b* of shaft 135 pass through aligned openings 166, 167 in first and second end walls 162, 164, respectively. One or more agitators 137 extend from and rotate with shaft 135 to stir and move toner within toner reservoir 112. Agitators 137 may include any suitable combination of paddles, prongs, stirrers, mixers, conveyors, etc. A drive gear 172 of second drive mechanism 170 is mounted on shaft 135 near second axial end 135*b* of shaft 135 such that rotation of drive gear 172 causes shaft 135 to rotate. FIG. 6 shows second drive mechanism 170 in more detail. In the example embodiment illustrated, second drive mechanism 170 includes drive gear 172, a compound idler gear 190 and a drive gear 182. Drive gear 182 is mounted on a shaft 131 of toner adder roll 130, which extends through a corresponding opening 133 in second end wall 164, such that drive gear 182 rotates with toner adder roll 130. Compound idler gear 190 is rotatably positioned at outer surface 164*b* of second end wall 164 and includes first and second sets of gear teeth gear 190*a*, 190*b* having different diameters. In the embodiment illustrated, first set of gear teeth 190*a* has a larger diameter than second set of gear teeth 190*b* and is positioned axially outboard of second set of gear teeth 190*b*. First set of gear teeth 190*a* meshes with drive gear 182 of toner adder roll 130 and second set of gear teeth 190*b* meshes with drive gear 172 of toner agitator 134. When toner adder roll 130 rotates upon being driven by first drive mechanism 168, drive gear 182 also rotates transferring rotational force to compound idler gear 190 and drive gear 172 which, in turn, rotates toner agitator 134.

With reference back to FIG. 5, outer surface 164*b* of second end wall 164 includes a boss 200 integrally formed therewith that protrudes outward along an axial dimension of toner agitator 134 at a location where second axial end 135*b* of shaft 135 passes through second end wall 164. In the example embodiment illustrated, boss 200 has a center opening 201 formed about opening 167 through which second axial end 135*b* of shaft 135 passes. In the example embodiment illustrated, center opening 201 of boss 200 has a larger diameter than opening 167 in second end wall 164. Opening 167 in second end wall 164 is sized to closely receive shaft 135 and center opening 201 of boss 200 is sized to receive an annular seal 220. Seal 220 is positioned near second axial end 135*b* of shaft 135 and within center opening 201 of boss 200. Seal 220 may be composed of any suitable flexible material. Seal 220 is positioned around an outer circumferential surface of shaft 135 and is sandwiched between an inner axial face 176 of drive gear 172 and outer surface 164*b* of second end wall 164 such that drive gear 172 compresses seal 220 against outer surface 164*b* of second end wall 164 when drive gear 172 is attached to shaft 135.

When drive gear 172 is attached to second axial end 135*b* of shaft 135, drive gear 172 encircles and is rotatably mounted on boss 200 so that drive gear 172 is free to rotate about boss 200. Boss 200 provides a bearing surface against which drive gear 172 rotates. The arrangement between boss 200, seal 220 and drive gear 172 provides a drive and sealing assembly for rotatably supporting drive gear 172 and for sealing the interface between shaft 135 and second end wall 164. This configuration eliminates the need to include a separate bushing or bearing component at the outer surface 164*b* of second end wall 164 to rotatably support drive gear 172 thereby reducing manufacturing complexity, reducing cost and permitting a more compact design along the axial dimension of toner agitator 134.

Figure 7A:
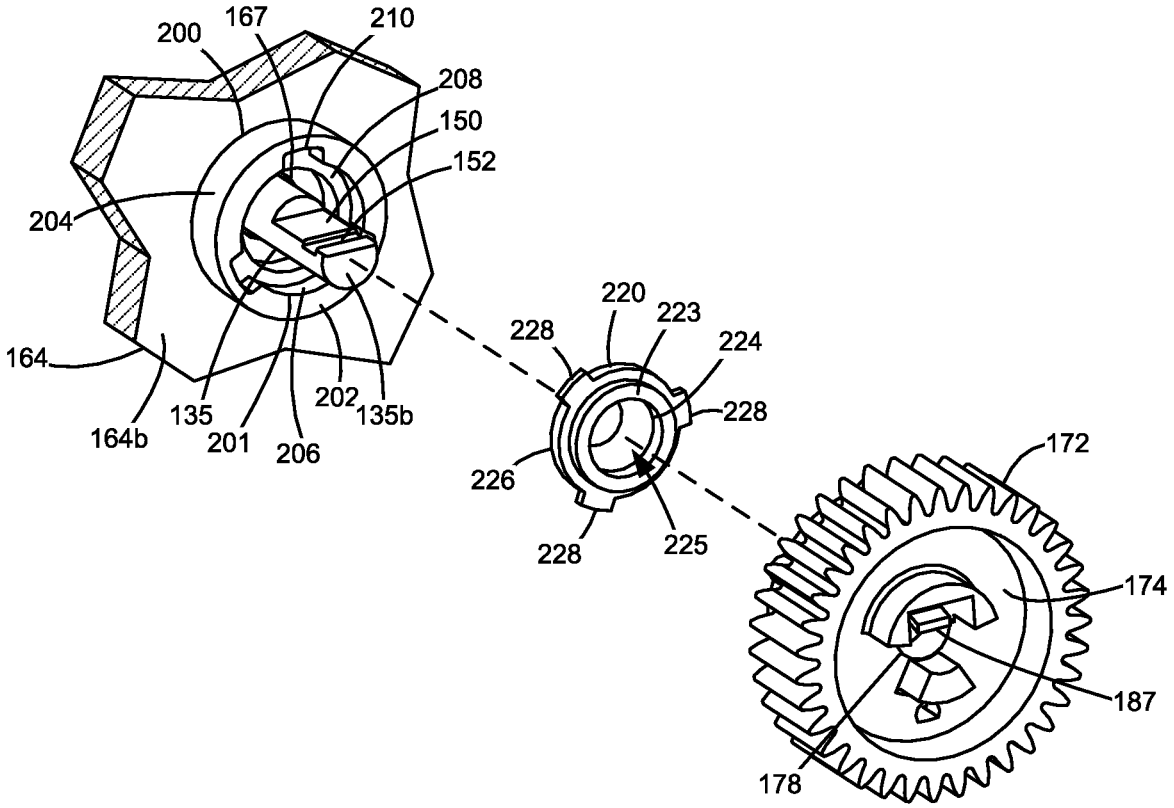
FIGS. 7A and 7B are perspective views illustrating a drive and sealing assembly of the developer unit of FIG. 4 in an unassembled state according to one example embodiment.
Figure 7B:
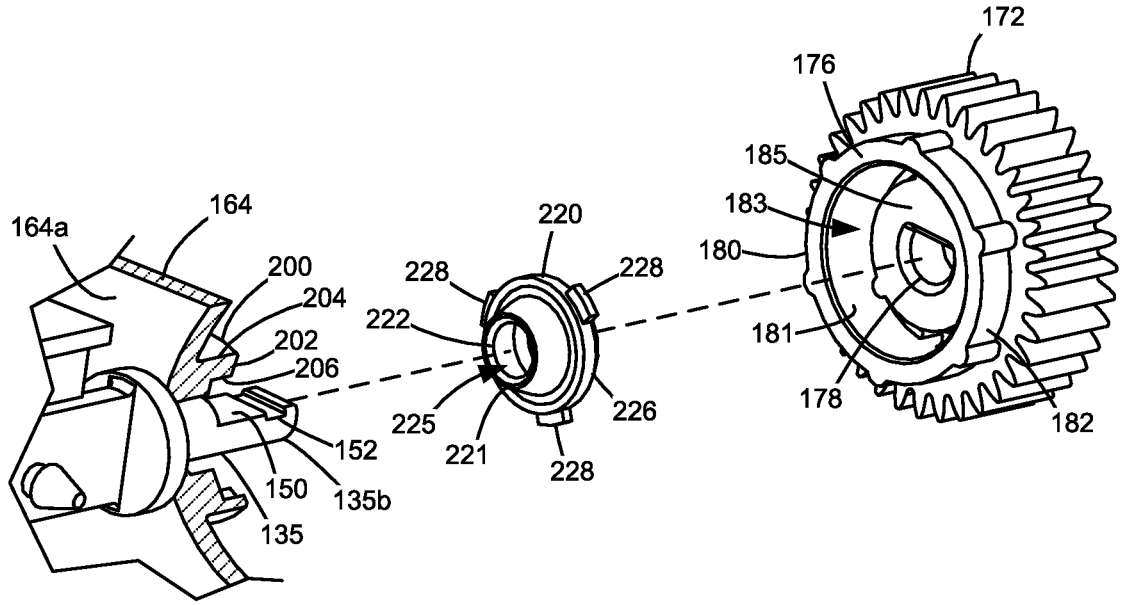

FIGS. 7A and 7B are perspective views illustrating drive gear 172 and seal 220 separated from shaft 135 and boss 200. In FIG. 7B, a portion of second end wall 164 including boss 200 is cut away to better illustrate second axial end 135*b* of shaft 135. In the example embodiment illustrated, drive gear 172 has outer and inner axial faces 174, 176. A D-shaped hole 178 is formed through drive gear 172. D-shaped hole 178 extends between outer and inner axial faces 174, 176 and is centered about a rotational axis of drive gear 172. Second axial end 135*b* of shaft 135 has a corresponding D-shaped portion 150 that fits into D-shaped hole 178 on drive gear 172 such that shaft 135 is constrained to rotate with drive gear 172. A catch 187 is positioned on outer axial face 174 of drive gear 172. When drive gear 172 is attached to second axial end 135*b* of shaft 135 by inserting D-shaped portion 150 of shaft 135 into D-shaped hole 178 of drive gear 172, catch 187 forms a snap fit engagement with a corresponding recess 152 on D-shaped portion 150 of shaft 135 to maintain axial alignment between drive gear 172 and shaft 135 and to prevent drive gear 172 from disengaging from shaft 135.

Drive gear 172 includes a collar 180 extending axially inward relative to shaft 135 on inner axial face 176. Collar 180 has an inner circumferential surface 181 and an outer circumferential surface 182. Inner circumferential surface 181 defines a cavity 183 that is centered about D-shaped hole 178 and that has an end surface 185 formed on inner axial face 176. In the example embodiment illustrated, boss 200 includes a generally cylindrical wall having an outer axial face 202, an outer circumferential surface 204 and an inner circumferential surface 206 that defines center opening 201. Outer circumferential surface 204 of boss 200 is sized to be received by cavity 183 of drive gear 172. A ledge 208 that faces outward relative to an axial dimension of toner agitator 134 is formed along inner circumferential surface 206 of boss 200 within center opening 201. One or more notches 210 are angularly spaced along inner circumferential surface 206 of boss 200 with each notch 210 extending from outer axial face 202 to ledge 208 of boss 200.

Seal 220 includes a first axial end 221, a second axial end 223 and a center opening 225 extending between first and second axial ends 221, 223. In the example embodiment illustrated, a first axial end 222 of opening 225 at first axial end 221 of seal 220 has a smaller diameter than a second axial end 224 of opening 225 at second axial end 223 of seal 220. First axial end 222 of opening 225 is sized to closely receive and contact an outer circumferential surface of shaft 135 when shaft 135 is passed through opening 225 of seal 220. Second axial end 223 of seal 220 forms a contact surface that contacts inner axial face 176 (e.g., end surface 185 within cavity 183) of drive gear 172 when drive gear 172 is assembled onto shaft 135. An outer ring 226 of seal 220 formed between first and second axial ends 221, 223 is sized to fit within center opening 201 of boss 200 and to contact ledge 208 within center opening 201 of boss 200. One or more retention lugs 228 extend radially outward from outer ring 226 and are positioned to align with and be received by corresponding notches 210 within center opening 201 of boss 200 to prevent seal 220 from rotating relative to boss 200.

Figure 8:
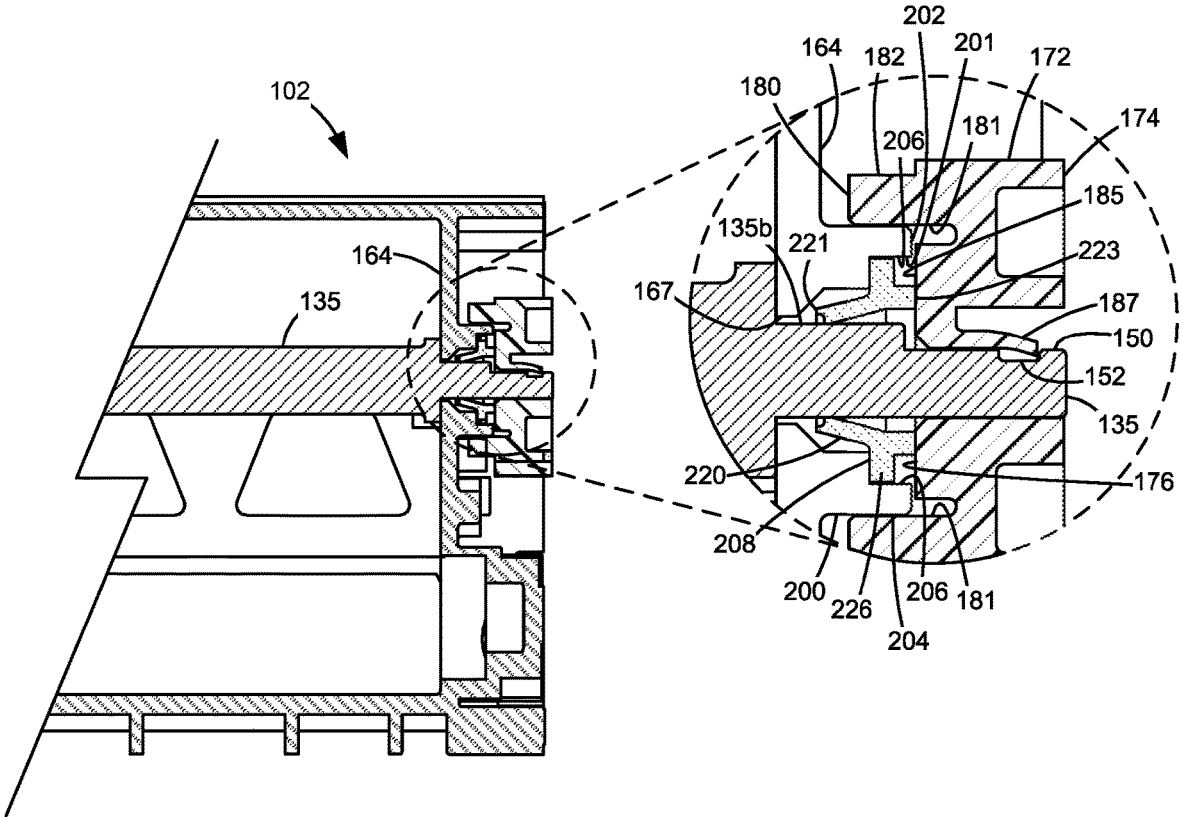
FIG. 8 is a side cross-sectional view of the drive and sealing assembly of FIGS. 7A and 7B in an assembled state according to one example embodiment.

FIG. 8 illustrates a side cross-sectional view of developer unit 102 with seal 220 and drive gear 172 assembled onto shaft 135 and boss 200. In the example embodiment illustrated, shaft 135 is free to move axially relative to body 160 to a limited degree. In this embodiment, inward axial movement of shaft 135 is limited by contact between shaft 135 and inner surface 164*a* of second end wall 164. In this embodiment, outward axial movement of shaft 135 is limited by contact between outer axial face 202 of boss 200 and inner axial face 176 (e.g., end surface 185 within cavity 183) of drive gear 172.

In the example embodiment illustrated, seal 220 is mounted on shaft 135, axially inward from D-shaped portion 150, such that seal 220 is positioned within center opening 201 of boss 200. First axial end 221 of seal 220 contacts an outer circumferential surface of shaft 135 thereby forming a sealing interface between seal 220 and shaft 135. Drive gear 172 is slid along D-shaped portion 150 of shaft 135 such that catch 187 latches onto recess 152 on D-shaped portion 150 of shaft 135. As drive gear 172 is assembled onto shaft 135, second axial end 223 of seal 220 contacts end surface 185 of drive gear 172 pushing seal 220 toward second end wall 164. The axial force provided by drive gear 172 against seal 220 presses outer ring 226 of seal 220 against ledge 208 within center opening 201 of boss 200 forming a sealing interface between outer ring 226 of seal 220 and ledge 208 of boss 200. The sealing interfaces between first axial end 221 of seal 220 and the outer circumferential surface of shaft 135 and between outer ring 226 of seal 220 and ledge 208 of boss 200 prevent any toner that passes from reservoir 112 through second opening 167 in second end wall 164 from escaping developer unit 102.

Further, in the example embodiment illustrated, drive gear 172 is mounted on boss 200 as drive gear 172 is pushed along shaft 135 toward second end wall 164 during assembly. When catch 187 of drive gear 172 latches onto recess 152 of shaft 135, collar 180 of drive gear 172 encircles boss 200. Inner circumferential surface 181 of collar 180 of drive gear 172 contacts at least a portion of outer circumferential surface 204 of boss 200 such that inner circumferential surface 181 of drive gear 172 bears against outer circumferential surface 204 of boss 200 to facilitate rotation of drive gear 172. In this example embodiment, no separate bushing or bearing component is provided between second end wall 164 and drive gear 172. Instead, bearing functionality at second axial end 135*b* of shaft 135 is achieved by forming boss 200 from the same second end wall 164 that directly bounds toner within toner reservoir 112 and by using an internal surface on drive gear 172 (i.e., inner circumferential surface 181 of collar 180) to bear against boss 200 to support rotation of drive gear 172. Further, drive gear 172 itself retains and compresses seal 220 against second end wall 164 forming the seal interface at second axial end 135*b* of shaft 135 and does not rely on a separate bushing or bearing component to compress seal 220 against second end wall 164.

With the above example embodiments, a bearingless drive gear 172 for toner agitator 134 is provided. Boss 200 formed on second end wall 164 provides the bearing for drive gear 172 without requiring a bearing element as an intermediate support. The configuration not only reduces the number of components to provide bearing and sealing functionality but also allows toner cartridge 100 to be designed in a more compact manner while achieving efficient bearing and seal performance.

Although the example embodiments discussed above have been described in the context of a drive and sealing assembly associated with a toner agitator of a toner cartridge, it will be appreciated that such a sealing assembly may be applied to other rotatable components in a toner cartridge and/or other assemblies of an image forming device, such as, for example, to developer roll 128 or toner adder roll 130.

Further, although the example embodiment discussed above includes a single replaceable unit in the form of toner cartridge 100 for each toner color, it will be appreciated that the replaceable unit(s) of the image forming device may employ any suitable configuration as desired. For example, in one embodiment, the main toner supply for the image forming device is provided in a first replaceable unit and the developer unit and photoconductor unit are provided in a second replaceable unit. In another embodiment, the main toner supply for the image forming device and the developer unit are provided in a first replaceable unit and the photoconductor unit is provided in a second replaceable unit. Other configurations may be used as desired.

Further, it will be appreciated that the architecture and shape of toner cartridge 100 illustrated in FIGS. 2-5 is merely intended to serve as an example. Those skilled in the art understand that toner cartridges, and other toner containers, may take many different shapes and configurations.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. An assembly for use in an electrophotographic image forming device, comprising:

a housing having a reservoir for holding toner, the housing includes a wall having an inner surface forming a boundary of the reservoir and an outer surface opposite the inner surface;

a rotatable shaft positioned in the reservoir, the rotatable shaft includes an end portion that passes through an opening in the wall;

a boss projecting from the outer surface of the wall about the opening;

a gear mounted on the end portion of the rotatable shaft outside of the reservoir and rotatably coupled to the rotatable shaft, the gear has an inner circumferential surface that contacts and bears against the boss facilitating rotation of the gear about the boss; and a seal positioned between an inner axial face of the gear and the outer surface of the wall, the inner axial face of the gear contacts the seal and presses the seal against the outer surface of the wall.

2. The assembly of claim 1, wherein the seal encircles and contacts an outer circumferential surface of the rotatable shaft.

3. The assembly of claim 1, wherein an outer ring of the seal contacts a ledge on the outer surface of the wall.

4. The assembly of claim 1, wherein the seal includes a plurality of lugs extending radially outward relative to the rotatable shaft and the outer surface of the wall includes a plurality of notches, each of the plurality of notches receives a corresponding one of the plurality of lugs constraining the seal from rotating relative to the wall.

* * * * *